US010913277B2

(12) United States Patent
Eck

(10) Patent No.: US 10,913,277 B2
(45) Date of Patent: Feb. 9, 2021

(54) PRINTING SYSTEM FOR PRINTING TO A RECORDING MEDIUM, AND METHOD FOR CLEANING PRINT HEADS OF A PRINTING SYSTEM

(71) Applicant: Océ Holding B.V., Venlo (NL)

(72) Inventor: Oliver Eck, Finsing (DE)

(73) Assignee: Canon Production Printing Holding B.V., Venlo (NL)

( * ) Notice: Subject to any disclaimer, the term of this patent is extended or adjusted under 35 U.S.C. 154(b) by 365 days.

(21) Appl. No.: 15/897,574

(22) Filed: Feb. 15, 2018

(65) Prior Publication Data

US 2018/0229505 A1 Aug. 16, 2018

(30) Foreign Application Priority Data

Feb. 16, 2017 (DE) ..... 10 2017 103 202

(51) Int. Cl.

| | |
|---|---|
| ***B41J 2/165*** | (2006.01) |
| ***B41J 25/00*** | (2006.01) |
| ***B41J 25/304*** | (2006.01) |
| ***B08B 1/00*** | (2006.01) |
| ***B41J 2/17*** | (2006.01) |

(Continued)

(52) U.S. Cl.

CPC ..... *B41J 2/16547* (2013.01); *B08B 1/005* (2013.01); *B41J 2/16517* (2013.01); *B41J 2/16526* (2013.01); *B41J 2/16588* (2013.01); *B41J 2/1721* (2013.01); *B41J 2/2103* (2013.01); *B41J 11/0045* (2013.01); *B41J 25/001* (2013.01);

(Continued)

(58) Field of Classification Search

None

See application file for complete search history.

(56) References Cited

U.S. PATENT DOCUMENTS 4,577,203 A * 3/1986 Kawamura ..... B41J 2/16511 347/30
2002/0105560 A1* 8/2002 Shimizu ..... B41J 2/16538 347/29
2004/0252161 A1* 12/2004 Bibl ..... B41J 2/155 347/42

FOREIGN PATENT DOCUMENTS

DE 69708570 T2 7/2002
DE 10233409 A1 2/2004

(Continued)

OTHER PUBLICATIONS

German Office Action dated Nov. 8, 2017, for German application No. 10 2017 103 202.9.

*Primary Examiner* — Erica S Lin
*Assistant Examiner* — Tracey M McMillion
(74) *Attorney, Agent, or Firm* — Schiff Hardin LLP

(57) ABSTRACT

A printing system for printing to a recording medium can include a guide, a printer, and a cleaner. The guide can guide the recording medium and be arranged in a first vertically traveling region. The printer having a print bar with a print head can print to the recording medium. The printer can be arranged in a printing position located in the first vertically traveling region, and be displaced, to facilitate the cleaning of the print head, into a service position located in a second vertically traveling region. The cleaner can be adapted to clean the print head. The cleaner can be arranged in a printing position located in the first vertically traveling region, and be displaced into the service position located in the second vertically traveling region to clean the print head. The cleaning can be automatically or manually performed.

15 Claims, 4 Drawing Sheets

(51) Int. Cl.
*B41J 2/21* (2006.01)
*B41J 11/00* (2006.01)

(52) U.S. Cl.
CPC ..... *B41J 25/304* (2013.01); *B41P 2235/21* (2013.01)

(56) References Cited

FOREIGN PATENT DOCUMENTS

| | | | |
|---|---|---|---|
| EP | 0832746 | B1 | 11/2001 |
| EP | 1445104 | A1 | 8/2004 |

* cited by examiner

PRINTING SYSTEM FOR PRINTING TO A RECORDING MEDIUM, AND METHOD FOR CLEANING PRINT HEADS OF A PRINTING SYSTEM

CROSS REFERENCE TO RELATED APPLICATIONS

This patent application claims priority to German Patent Application No. 102017103202.9, filed Feb. 16, 2017, which is incorporated herein by reference in its entirety.

BACKGROUND

The disclosure relates to printing systems for printing to a recording medium, and methods to clean print heads of such printing systems.

The present disclosure are explained with reference to inkjet printing. However, the disclosure is not limited to inkjet printing and embodiments can be configured to many and various printing methods.

In inkjet printing, a multicolor, contact-less, direct printing takes place using thermal or electrophysical principles. Starting from nozzle surfaces, ink droplets in liquid form are thereby fired from print heads onto the printing medium. For example, inkjet printing is explained in the publication DE 102 33 409 A1.

Numerous measures exist for quality improvements in inkjet printing. The regular cleaning of the print heads or of their nozzle surfaces represents such a measure.

In particular, in multicolor inkjet printers, a plurality of what are known as print bars is normally provided in a printer. A print bar is provided with one or more respective print heads. The different inks may have various ink structures (e.g. base, dye, base pigment, base polymer), whereby the nozzle surfaces of the print heads of the different print bars are contaminated at different rates and severity. The different ink structures can thus be cleaned off more or less easily from the nozzle surface. Nozzles that fire at an angle or entirely clogged nozzles may occur due to ink residues on the nozzle surfaces of the print heads. Such disruptions lead to unwanted streaks in the print image and thus negatively affect the print quality.

In order to clean the print heads of ink residues, an automatic print head cleaning is implemented in specific cycles, for example. For example, EP 1 445 104 B1 describes a method for automatic cleaning of print heads. Alternatively, a manual cleaning of the nozzle surfaces may also be implemented.

Sometimes, the cleaning of the print heads can be generally performed at a cleaning station of a printing system that is provided separately for this. The cleaning station can be normally arranged downstream of a printing station of the printing system. A printer having the print heads is shifted from the printing station to the cleaning station, corresponding to the cleaning. The cleaning station therefore requires an installation space that is similar to that of the printing station.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1:
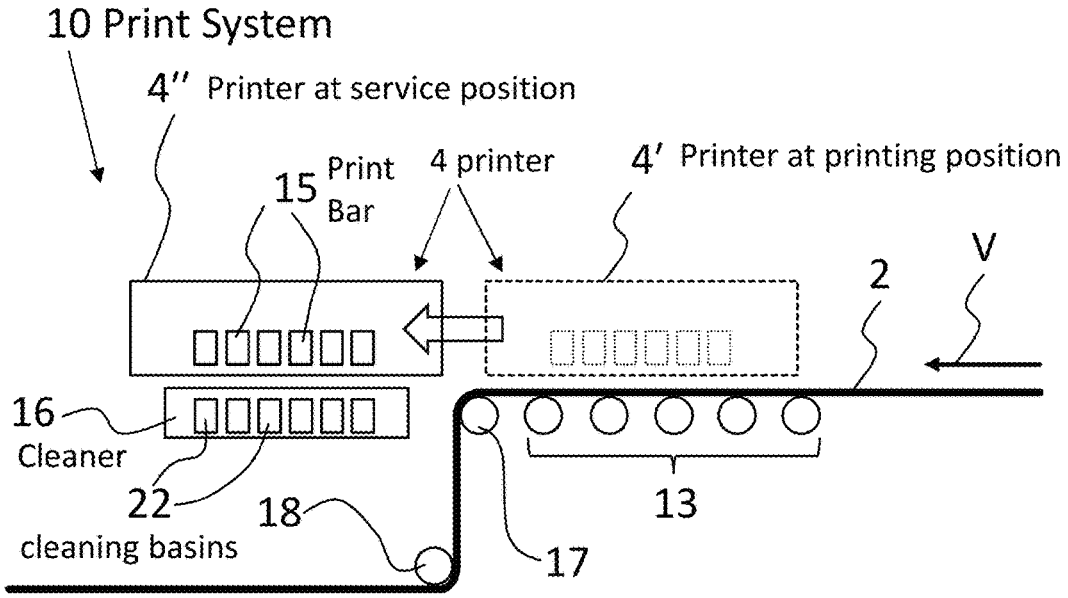
FIG. 1 illustrates a side view of a printing system.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the present disclosure is to provide an improved printing system as well as an improved method for cleaning of print heads of such a printing system.

The disclosure relates to a printing system for printing to a recording medium. The printing system can include a guide configured to guide the recording medium. The guide can be arranged in a first vertically traveling region. The printing system can also include a printer which has at least one print bar having at least one print head. The printer is configured to print to the recording medium and can be arranged at a printing position of the printer that is located in the first vertically traveling region. The printer can be configured to be shiftable and can be shifted into a service position to clean the print head of the printer. The service position is located in a second vertically traveling region. Moreover, the printing system can include a cleaner configured to automatically clean the print head. The cleaner can be arranged in a printing position. In this example, the printing position of the cleaner is located in the first vertically traveling region, and the cleaner is configured to be shifted into its service position (26") to automatically clean the print head. The service position (26") is located in the second vertically traveling region.

The disclosure also relates to a method for automatic cleaning of print heads of a printing system, including the automatic cleaning of a printing system according to embodiments of the present disclosure. In one or more exemplary embodiments, a printer having at least one print head can be repositioned from its printing position into its service position (e.g. using a guide, such as a guide rail). In these examples, the printing position is situated in a first vertically traveling region (B1) and the service position is situated in a second vertically traveling region (B2). A cleaner can also be repositioned from its printing position into its service position. The printing position for the cleaner is situated in the first vertically traveling region and the service position for the cleaner is situated in the second vertically traveling region. The print head is then automatically cleaned by the cleaner located in the service position.

The disclosure also relates to a method for manual cleaning of print heads of a printing system, including the manual cleaning of a printing system according to embodiments of the present disclosure. A printer can include at least one print head, and can be shifted from its printing position into its service position. The printing position of the printer is situated in a first vertically traveling region and the service position of the printer is situated in a second vertically traveling region. A cleaner is also positioned in its printing position that is situated in the first vertically traveling region. The print head accessible in the service position can then be manually cleaned.

The printing systems of the present disclosure can include an installation space that may be advantageously utilized by a novel arrangement of individual units.

In one or more exemplary embodiments, an arrangement is provided of a cleaner configured to automatically clean print heads in relation to a printing position on the other side of the guide.

A displacement capability of the cleaner in two dimensions, in particular even in the height direction, and the arrangement of the service position in the earlier "clearance volume", in particular below the guide, is this provided in a previously unknown manner. A novel arrangement of the service position is therefore also enabled. This is synergistically advantageous overall since the printing system size may thus be markedly reduced. In particular, the length of the printing system is markedly reduced since the installation space of a cleaning station, which installation space is sometimes provided for a longitudinal displacement of the printer for cleaning and which requires at least the same length as the printer, is now no longer required. Instead of this, according to the disclosure, the cleaning station of the printing system is integrated with the printing station into a common module. According to the disclosure, a manual cleaning and an automatic cleaning nevertheless likewise remain possible, as given an earlier cleaning station. In particular, a good accessibility of the printer for manual cleaning is preserved.

The two or more of the exemplary embodiments and developments can be combined with one another as would be understood by one of ordinary skill in the arts. In particular, all features of a printing system can be transferred to one or more exemplary methods for automatic or manual cleaning of a printer, and vice versa.

Additional possible embodiments, developments and implementations of the disclosure include combinations of previous features or features of the disclosure that are described in the following with regard to the exemplary embodiments, even if not explicitly cited. In particular, the person skilled in the art will thereby also add individual aspects as improvements or additions to the respective basic form of the present disclosure.

FIG. 1 shows a schematic side view of a conventional printing system 10 for printing to a recording medium 2, for example a paper web. The printing system 10 includes at least one printer 4 that is movable between a printing position 4' and service position 4". The printer 4 includes one or more print bars 15. The printer 4 shown in FIG. 1 includes six print bars 15 and a cleaner 16, but is not limited thereto. Each print bar 15 may have one or multiple—here five—print heads 5 that may be arranged in one or multiple rows. The dashed-line illustration of the printer 4 reflects the printer 4 in its printing position 4'. In this printing position, the printer 4 in FIG. 1 is located to the right, immediately above the recording medium 2. The solid-line illustration of the printer 4 reflects the printer 4 in its service position 4". In the service position 4", the printer 4 in FIG. 1 is located in the left position and is thereby at a distance from the recording medium 2.

The cleaning station 16 is located in a paper feed direction V, longitudinally behind the printer 4' in the printing position, or below the printer 4" in the service position. A guide roller system 13 (or also more generally referred to as a guide) that guides the recording medium 2 has a stepped deflection formed with the deflection rollers 17, 18, which stepped deflection deflects the recording medium 2 around the cleaner 16.

To clean the print heads 5 of the printer 4 that are arranged in the print bars 15, it is thus necessary to shift this printer 4 from the right to the left, out of its printing position 4' into the service position 4" in FIG. 1, so that the nozzle plates 19 of the print heads 15 that are to be cleaned are accessible to the cleaner 16.

For automatic cleaning by purging/wiping, the cleaner 16 has multiple cleaning basins 22 or what are known as "purge basins" in order to catch ink flushed through or "purged" from the print heads and supply said ink to a disposal or waste system (not shown). In particular, a separate cleaning basin 22 can be provided below each print bar 15.

A cleaning tool provided with a wiping lip, what is known as a wiper, is integrated into the cleaning basin 22. The wiper strips the remaining ink residues from the nozzle surface with the wiping lip after the "purging."

To implement the automatic cleaning by purging/wiping, the printer 4 is moved in the paper feed direction V until the print heads 5 or print bar 15 are/is situated exactly over the corresponding purge basin 22 in the cleaner 16. The print bars 15 are subsequently lowered vertically and the purge/wipe process may be started.

Figure 2:
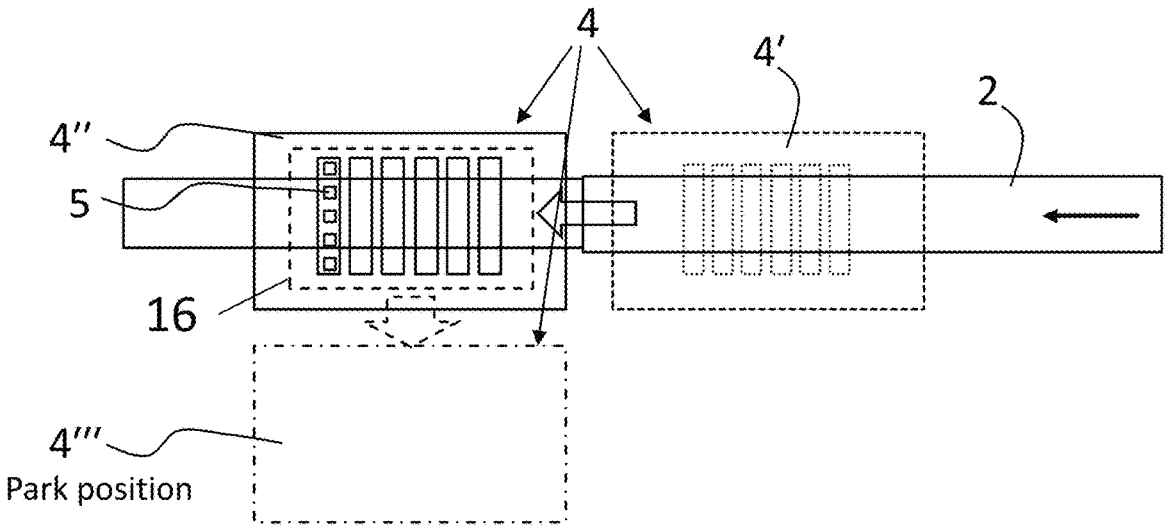
FIG. 2 illustrates a top view of the printing system from FIG. 1.

FIG. 2 shows a top view of the printing system 10 of FIG. 1.

The nozzle surfaces of the print heads 5 of a print bar 15 are additionally manually cleaned at defined time intervals to bring the print heads 5 into an essentially residue-free state again. In spite of regular automatic cleaning, this is necessary—in particular given the use of quick-drying inks—in order to ensure a high print quality over the long term.

Given such a manual cleaning process, an operator manually wipes the nozzle surface clean with a cleaning cloth that is saturated with cleaning fluid. Accordingly, a manual accessibility of the nozzle surfaces is required for this.

For the manual cleaning, the printer 4 therefore initially moves into the service position 4". In contrast to the automatic purge/wipe cleaning, however, the cleaner 16 is additionally displaced transversal to the paper feed direction V into a park position 4'" that is situated next to the cleaner 16, such that the print bars 15 are manually accessible from below to a user or operator. The park position 4'" is schematically depicted with a dash-dot line in FIG. 2.

Modern requirements for the device architecture of a printing system require an optimal utilization of the available installation spaces. For example, a compact system size and often an optimally straight paper run are required.

However, the displacement of the cleaner 16 that is depicted in FIGS. 1 and 2 between the two required positions at the same height level requires ample spatial conditions. Also, a straight course of the recording medium 2 is not possible.

Figure 3:
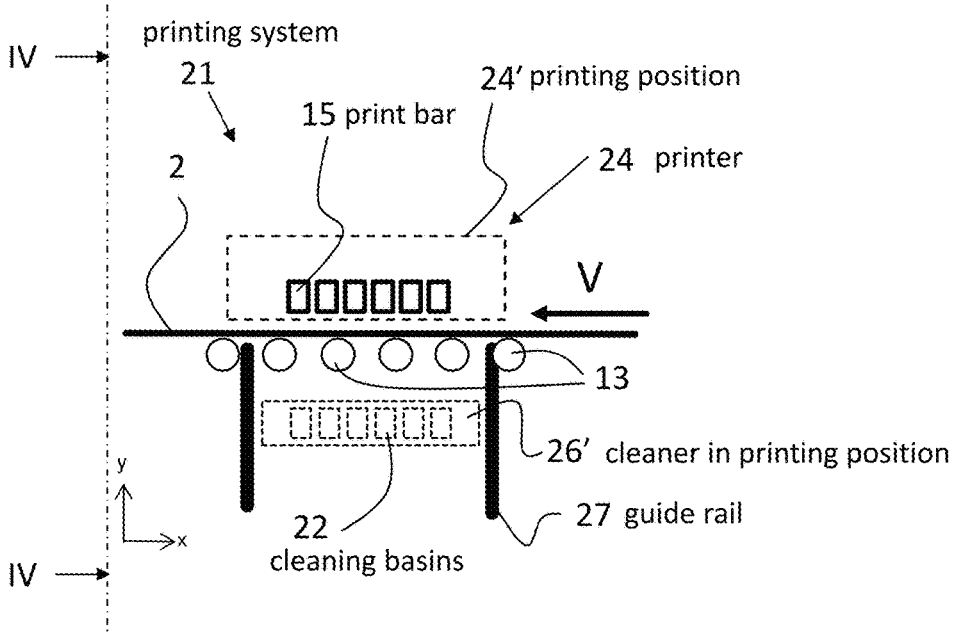
FIG. 3 illustrates a side view of a printing system according to an exemplary embodiment of the present disclosure.
Figure 4:
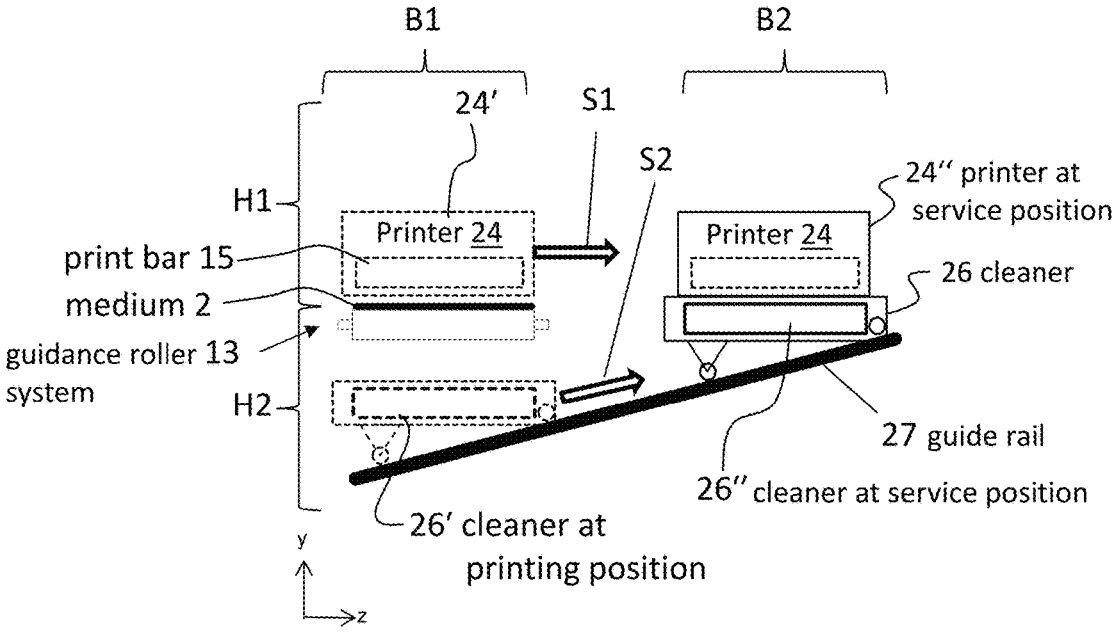
FIG. 4 illustrates a cross section view of the printing system of FIG. 3 via the line IV-IV.
Figure 5:
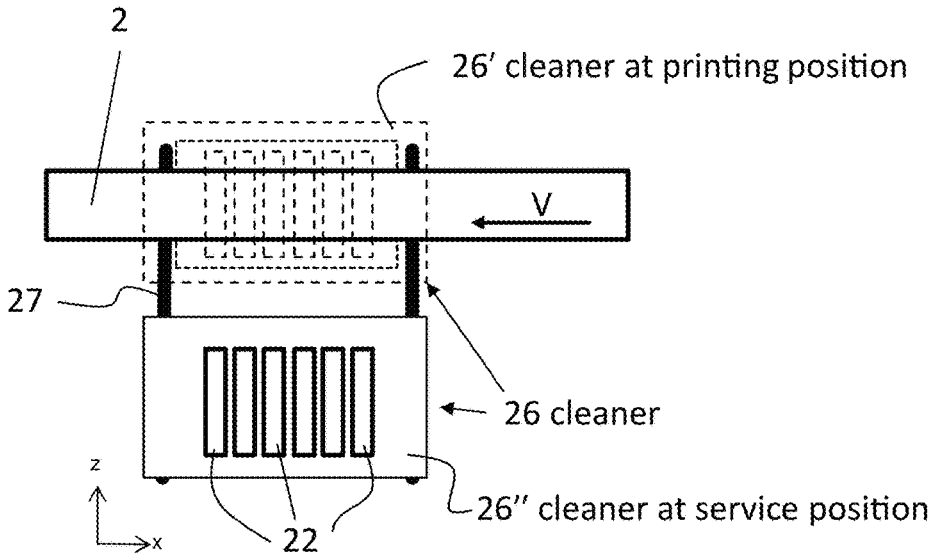
FIG. 5 illustrates a plan view of the printing system of FIG. 3.

FIG. 3 illustrates a schematic side view of a printing system 21 according to an exemplary embodiment of the present disclosure. FIG. 4 shows a cross section through the printing system along the line Iv-Iv in FIG. 3. FIG. 5 shows a plan view of the printing system 21 from FIG. 3.

In an exemplary embodiment, the printing system 21 is configured to print to various recording media 2. For example, the recording media 2 can include papers, cardboards, films, plastics, metals, textiles, tissue, or the like.

The shown region of the printing system 21 deals with an integrated printing and cleaning station. This may in particular be provided as a component of a printing installation with additional components, such as a takeup station and takeoff station, drying route, etc.

It is advantageous that the printing system 21 can be configured with a more compact design in comparison to the printing system 10 from FIGS. 1 and 2. The recording medium 2 is also deflected less often so that the course of the recording medium 2 is simplified and may even travel in an essentially straight line, such that the mechanic stress on the recording medium 2 can be reduced.

In an exemplary embodiment, the printing system 21 has a guidance roller system 13 with multiple conveying rollers or rollers configured to guide the recording medium 2. For example, the guidance roller system can be referred to as a roller saddle with multiple conveying rollers arranged in a row or in a slight arc.

In a first horizontally traveling region H1 that travels above the guidance roller system 13, a printer 24 is arranged in the printing position 24' above the recording medium 2. The printer 24 has at least one print bar 15. In an exemplary embodiment, the printer 24 includes processor circuitry that is configured to perform one or more functions and/or operations of the printer 24, such as to print to one or more recording media 2.

The guidance roller system 13 has a predetermined feed direction V along which it guides the recording medium 2. In particular, the guidance roller system 13 guides the recording medium 2 along the feed direction V in FIG. 3, from right to left. The feed direction may also travel from left to right.

In an exemplary embodiment, a plurality of print bars 15 are provided in succession in the feed direction V of the recording medium 2 for the application of different colors onto the recording medium 2. In particular, each print bar may have multiple installed print heads 5 to print to a wider recording medium 2 over its entire width in one pass.

In an exemplary embodiment, a cleaner 26 is provided. The cleaner 26 can be configured to automatically clean the print heads 5 and/or their nozzle surfaces. In an exemplary embodiment, the cleaner 26 includes processor circuitry that is configured to perform one or more functions and/or operations of the cleaner 26, such as to clean (e.g. automatically clean) the print heads 5. Both the printer 24 and the cleaner 26 can be displaced from a printing position 24' or 26' into a service position 24" or 26", as depicted in FIGS. 4 and 5. The printing positions 24' or 26' of the printer 24 and cleaner 26, respectively, are located in the first vertically traveling region B1, and the service positions 24" or 26" of the printer 24 and cleaner 26, respectively, are located in a second vertically traveling region B2 that travels parallel to the first region B1 and is arranged adjacent thereto. The printer 24 is arranged in a first horizontally traveling region H1 that is located above the guidance roller system 13. In contrast to this, the cleaner 26 is arranged in a second horizontally traveling region H2 that is located below the first horizontally traveling region H1. Both horizontally traveling regions H1 and H2 travel orthogonal to the feed direction V (i.e., along the z-direction).

In an exemplary embodiment, the printer 24 in the printing position 24' can be shifted into the service position 24" for cleaning of the print heads 5, which is illustrated in FIGS. 4 and 5. The service position 24" is situated laterally next to the guidance roller system 13. In an exemplary embodiment, the printer 24 in the printing position 24' is displaced horizontally, transversal to the feed direction V of the recording medium 2 (i.e. in the z-direction), as is indicated with the arrow S1. It may thereby be a linear displacement.

In an exemplary embodiment, in the printing position 26', the cleaner 26 is located directly below the guidance roller system 13 in the second horizontally traveling region H2 and in the first vertically traveling region B1. What is generally intended by the printing position 26' is the position that the corresponding printer 24 or cleaner 26 assumes when the printing system 21 performs one or more printing operations (e.g. when the printer 24 prints to the recording medium 2).

In an exemplary embodiment, for automatic cleaning of the print heads 5, the cleaner 26 may be shifted from the printing position 26' into the service position 26". For this, the cleaner 26 can be displaced (from the printing position 26') diagonally in a first dimension directed transversal to the feed direction V, and in a second dimension directed transversal to the feed direction, into the service position 26".

In an exemplary embodiment, in the printing position the cleaner 26 is configured to be linearly displaceable in the YZ-direction (e.g. upward or in the height dimension in the y-direction, and to the side or in the transversal dimension in the z-direction) into the service position 26", as is indicated with the arrow S2. In an exemplary embodiment, at least one linear, diagonally traveling guide rail 27 is provided for a corresponding guidance of the cleaner 26.

In an exemplary embodiment, the displacement takes place via an actuator or motor, such that the printer 24 can be automatically displaced between the printing position 24' and the service position 24" and the cleaner 26 can be automatically displaced between the printing position 26' and the service position 26". Alternatively or additionally, a manual displacement capability may also be provided. In an exemplary embodiment, the printing system 21 includes a controller that is configured to control the displacement of the printer 24 and/or cleaner 26, such as controlling the actuator(s)/motor(s). In an exemplary embodiment, the controller includes processor circuitry that is configured to perform one or more functions and/or operations of the controller, such as controlling the displacement of the printer 24 and/or cleaner 26.

In an exemplary embodiment, for manual cleaning, the printer 24 can be configured to be displaceable independently of the cleaner 26 into the service position 24". The printer 24 is thus manually cleanable via the print head 5 accessible in the service position 24" while the cleaner 26 remains in the printing position 26'. Or, however, the printer 24 remains in its printing position 24' while the cleaner 26 is displaced into the service position 26".

In particular, the printer 24 and the cleaner 26 can be displaced independently of one another. Accordingly, in an exemplary embodiment, drives are provided for displacement of the cleaner 26 and the printer 24. The drives can be, for example, belt drives, spindle drives, linear motors, power trains, corresponding motors and/or the like, that can be operated independently of one another.

As in FIGS. 3 and 4, in FIG. 5 an arrangement of the cleaner 26 is shown in the service position 26" with solid lines. The printing position 26' of the cleaner 26 is depicted with dashed lines.

In one or more exemplary embodiments, the installation space that is available for the printing position 26' of the cleaner 26 is located below the guidance roller system 13 guiding the recording medium 2, in a second horizontally traveling region H2, height-offset and transversally offset relative to the service position 26". In an exemplary embodiment, to move the cleaner 26 between the printing position 26' and the service position 26", the cleaner 26 moves both upward (y-direction) and laterally (in the z-direction), for which at least one guide rail 27 is provided as is depicted in FIG. 4. In an exemplary embodiment, the cleaner 26 can be moved with high accuracy and reproducibility between the printing position 26' and the service position 26" via a corresponding, positionally accurate guidance in the guide rails 27, for example a prismatic guidance. Depending on the slope of the guide rail 27 and the weight of the cleaner 26, the movement may take place manually or be motorized.

In one or more exemplary embodiments, the printing system 21 enables a fast achievement of the service position 24" or 26", both by the printer 24 and by the cleaner 26. Advantageously, this in turn enables a quick start of the print head cleaning and thus reduces the danger of additional drying out of ink residues on the nozzle surface or nozzle plate of a print head 5.

Since a linear diagonal movement of the cleaner 6 produces both the necessary horizontal and vertical offset of the cleaner 6, precise end positions may be achieved with repeat accuracy without complicated control. It is thus a simple and certain movement sequence. Moreover, the transposition via a simple linear movement is also comparably cost-effective, since in particular no combined drive techniques are necessary for horizontal and vertical movement.

The size of the printing system 21 may also be reduced via the arrangement of the printing position 26' of the cleaner 26 below the guidance roller system 13, in particular in a clearance volume under the roller saddle, and via the arrangement of the service position 26" next to the guide 13.

Figure 6:
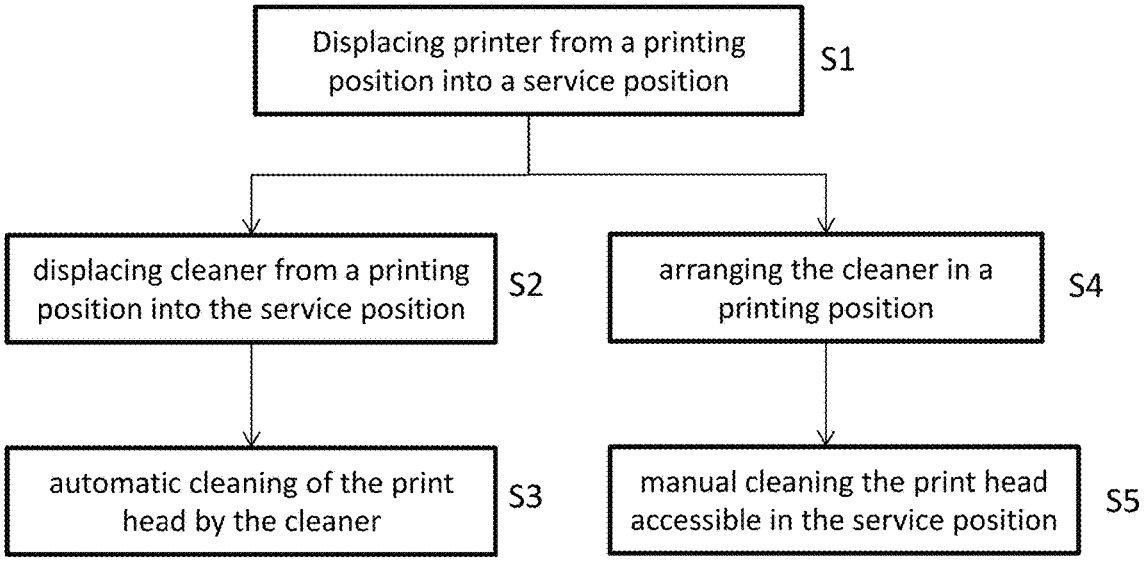
FIG. 6 illustrates a flowchart of a method according to an exemplary embodiment of the present disclosure.

FIG. 6 shows a flowchart of a cleaning method according to an exemplary embodiment of the disclosure.

In an exemplary embodiment, two method variants of an automatic and manual cleaning of the print heads are presented, which are symbolized by a branching of the flowchart after operation S1 in FIG. 6. The left branch presents the automatic cleaning of the print heads. The right branch of the flowchart presents the manual cleaning of the print heads.

In both method variants, in operation S1, the printer 24 having at least one print head 5 is displaced from a printing position 24' into a service position 24". As explained with regard to FIGS. 4 and 5, the service position 24" is situated laterally next to the guide 13. For example, the printer 24 may therefore be displaced transversal to a feed direction V of the guidance roller system 13 and/or linearly from the printing position 24' into the service position 24".

In an exemplary embodiment, the method for automatic cleaning of print heads 5 of a printing system 21, which represents the left branch in the block diagram according to FIG. 6, also includes a step S2 of displacing a cleaner 26 configured for automatic cleaning of the print head 5 from a printing position 26' into the service position 26". As is explained with regard to FIGS. 4 and 5, the displacement may in particular be performed diagonally and/or linearly. For example, for this, a linear guide rail 27 traveling diagonally upward and to the side is provided, as shown in FIG. 4. In an exemplary embodiment, two guide rails 27 traveling parallel to one another are used.

In an exemplary embodiment, in operation S3, the print head 5 is automatically cleaned by the cleaner 26 in the service position 26". In an exemplary embodiment, the automatic cleaning S3 includes a purging and wiping to clean the nozzle surface of a print head 5 to be cleaned, in particular multiple print heads of a print bar 15 that are to be cleaned, of the printer 24.

In an exemplary embodiment, to implement the automatic cleaning by purging/wiping, the print head 5 to be cleaned is arranged over (e.g. exactly/directly over) a cleaning basin 22 of the cleaner 26 and the purge/wipe process is started. In an exemplary embodiment, the print bar of the printer 24 may be lowered vertically for the purge/wipe process, possibly for purging and wiping at different heights.

In an exemplary embodiment, for a manually cleaning method (right-side branch), following the displacement S1 of a printer 24 from a printing position 24' into a service position 24", the method for manual cleaning of print heads includes the arranging S4 of the cleaner 26 in a printing position 26'. Insofar as the cleaner 26 is already located in the printing position 26' before or during step S1, the arrangement S4 accordingly includes leaving the cleaner 26 in the printing position 26'. The printer 24 is accordingly displaced independently of the cleaner 26 into the service position 24" so that the nozzle surface of the print head 5 of the printer 24 is accessible for manual cleaning.

In an exemplary embodiment, the print head 5 accessible in the service position 24" is manually cleaned at step S5. For this, in the service position 24", the nozzle surface is wiped clean by a user, service person or operator, in particular manually, with a cleaning cloth saturated with cleaning fluid. For example, for this an accessibility of the print head 5 or of its nozzle plate from below is provided.

The manual cleaning at predetermined time intervals is conducive to the long-term preservation of a desired print quality, in particular given the use of quick-drying ink, in order to bring the print heads into a completely residue-free state again.

Figure 7:
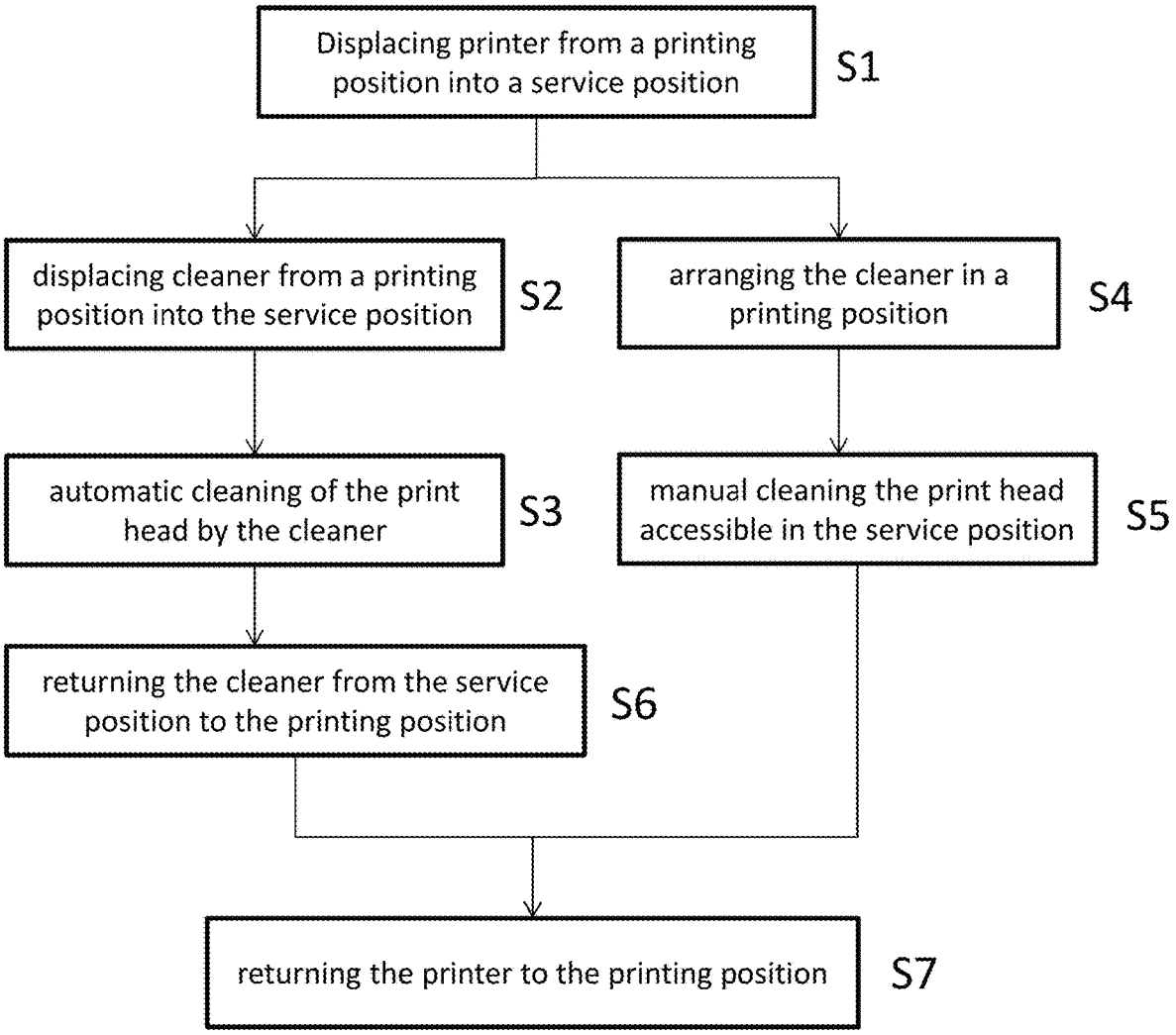
FIG. 7 illustrates a flowchart of a method according to an exemplary embodiment of the present disclosure.

FIG. 7 illustrates a flowchart a cleaning method according to an exemplary embodiment of the disclosure.

In an exemplary embodiment, the cleaning method illustrated in FIG. 7 is an extension of the method according to the exemplary embodiment according to FIG. 6. The same steps S1 through S5 are accordingly provided.

In an exemplary embodiment, given the automatic cleaning of print heads 5 according to the left branch of the flowchart according to FIG. 7, the cleaner 26 is returned S6 from the service position 26" into the printing position 26' following the automatic cleaning S3. In particular, a possible accessibility to additional components that is advantageous for printing, for example to an ink reservoir station arranged below the service position, may thus be produced.

In an exemplary embodiment, in both variants (manual and automatic cleaning methods), the printer 24 is returned S7 into the printing position 24'. The system is thus again placed into an initial state provided for printing.

Although the present disclosure has been described in the preceding entirely using preferred exemplary embodiments, it is not limited to these, but rather can be modified in many and numerous ways.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, "processor circuitry" includes one or more circuits, one or more processors, logic, or a combination thereof. For example, a circuit can include an analog circuit, a digital circuit, state machine logic, other structural electronic hardware, or a combination thereof. A processor can include a microprocessor, a digital signal processor (DSP), or other hardware processor. In one or more exemplary embodiments, the processor can include a memory, and the processor can be "hard-coded" with instructions to perform corresponding function(s) according to embodiments described herein. In these examples, the hard-coded instructions can be stored on the memory. When the instructions are executed by the processor, the processor performs the corresponding function(s) associated with the processor, and/or one or more functions and/or operations related to the operation of a component having the processor included therein. Alternatively or additionally, the processor can access an internal and/or external memory to retrieve instructions stored in the internal and/or external memory, which when executed by the processor, perform the corresponding function(s) associated with the processor, and/or one or more functions and/or operations related to the operation of a component having the processor included therein.

In one or more of the exemplary embodiments described herein, the memory can be any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

2 recording medium
4 printer
4' printer 4 in printing position
4" printer 4 in service position
4'" printer 4 in park position
5 print head
6 cleaner
10 printing system
13 guidance roller system
15 print bar
16 cleaner
17, 18 deflection roller
21 cleaning basin
22 printing system
24 printer
24' printer 24 in printing position
24" printer 24 in service position
26 cleaner
26' cleaner 26 in printing position
26" cleaner 26 in service position
27 guide rail
B1 first vertically traveling region
B2 second vertically traveling region
H1 first horizontally traveling region
H2 second horizontally traveling region
V feed direction
S1-S7 method operations

The invention claimed is:

1. A printing system for printing to a recording medium, comprising:

a guide configured to guide the recording medium, the guide being arranged in a first vertically traveling region;

a printer including at least one print bar having at least one print head to print to the recording medium, and configured to:

be arranged in a printing position located in the first vertically traveling region, and be displaced, to facilitate the cleaning of the print head, into a service position located in a second vertically traveling region; and a cleaner to clean the print head, the cleaner being configured to:

be arranged in a printing position located in the first vertically traveling region, and be displaced from the printing position diagonally in a first dimension directed transversal to a paper feed direction and in a second dimension directed transversal to the paper feed direction, into the service position located in the second vertically traveling region, to automatically clean the print head.

2. The printing system according to claim 1, wherein:

the printer is arranged in a first horizontally traveling region which runs above the guide, and/or the cleaner is arranged in a second horizontally traveling region that is arranged below the first horizontally traveling region.

3. The printing system according to claim 1, wherein the guide is arranged along the feed direction along which the guide is configured to guide the recording medium.

4. The printing system according to claim 3, wherein the printer is configured to be displaced transversal to the feed direction from the printing position into the service position.

5. The printing system according to claim 1, wherein the second vertically traveling region is arranged next to the first vertically traveling region.

6. The printing system according to claim 1, wherein the cleaner is configured to be displaced linearly between the printing position and the service position by at least one linear guide rail.

7. The printing system according to claim 1, wherein the printer is configured to be horizontally displaced linearly from the printing position into the service position.

8. The printing system according to claim 1, wherein the printer is configured to be displaced into the service position independently of the cleaner.

9. A method for cleaning of print heads of a printing system, comprising:

displacing a printer having at least one print head from a printing position of the printer into a service position of the printer, the printing position being situated in a first vertically traveling region above a guide configured to guide a print medium, and the service position being situated in a second vertically traveling region adjacent to the first vertically traveling region;

displacing a cleaner of the printing system from a printing position of the cleaner diagonally upward in a first dimension directed transversal to a feed direction of the guide and laterally in a second dimension directed transversal to the feed direction to displace the cleaner into a service position of the cleaner, the printing position of the cleaner being situated in the first vertically traveling region and the service position of the cleaner being situated in the second vertically traveling region; and cleaning the at least one print head by the cleaner located in the service position.

10. The method according to claim 9, wherein the diagonal displacement is performed linearly using at least one linear guide rail.

11. The method according to claim 9, wherein:

the service position of the printer is situated laterally next to the guide; and/or the printer is displaced transversal to a feed direction of the guide and/or linearly from the printing position of the printer into the service position of the printer.

12. The method according to claim 9, wherein the cleaning of the at least one print head by the cleaner is performed automatically.

13. A method for cleaning of print heads of a printing system, comprising:

displacing a printer having at least one print head from a printing position of the printer into a service position of the printer, the printing position of the printer being situated in a first vertically traveling region above a guide configured to guide a print medium, and the service position of the printer being situated in a second vertically traveling region;

displacing a cleaner of the printing system from a printing position of the cleaner, situated in the first vertically traveling region, diagonally upward in a first dimension directed transversal to a feed direction of the guide and laterally in a second dimension directed transversal to the feed direction to displace the cleaner into a service position of the cleaner; and cleaning the print head accessible in the service position.

14. The method according to claim 13, wherein:

the service position of the printer is situated laterally next to the guide; and/or the printer is displaced transversal to a feed direction of the guide and/or linearly from the printing position of the printer into the service position of the printer.

15. The method according to claim 13, wherein the cleaning of the at least one print head by the cleaner is performed automatically.

* * * * *